US008955449B2

(12) United States Patent
Falcone

(10) Patent No.: US 8,955,449 B2
(45) Date of Patent: Feb. 17, 2015

(54) FLOATING DOCK COMPONENTS AND ASSEMBLY

(71) Applicant: Paul Patrick Falcone, Saint Petersburg, FL (US)

(72) Inventor: Paul Patrick Falcone, Saint Petersburg, FL (US)

(73) Assignee: Global Dock and Marina Systems, LLC, Miami, FL (US)

( * ) Notice: Subject to any disclaimer, the term of this patent is extended or adjusted under 35 U.S.C. 154(b) by 124 days.

(21) Appl. No.: 13/731,088

(22) Filed: Dec. 30, 2012

(65) Prior Publication Data

US 2014/0182504 A1 Jul. 3, 2014

(51) Int. Cl.
*B63B 35/44* (2006.01)
*E02B 3/06* (2006.01)

(52) U.S. Cl.
CPC ..... *E02B 3/064* (2013.01)
USPC ..... 114/263; 114/264; 114/265; 114/266; 114/267

(58) Field of Classification Search
USPC ..... 114/263–267
See application file for complete search history.

(56) References Cited

U.S. PATENT DOCUMENTS

| | | | | |
|---|---|---|---|---|
| 4,655,156 | A * | 4/1987 | Svirklys et al. | 114/266 |
| 4,768,456 | A * | 9/1988 | Jones et al. | 114/266 |
| 5,199,371 | A * | 4/1993 | Meriwether | 114/267 |
| 5,460,114 | A * | 10/1995 | McMillan | 114/267 |
| 5,732,649 | A * | 3/1998 | Falcone | 114/263 |
| 5,915,325 | A * | 6/1999 | Gerber et al. | 114/263 |
| 5,950,558 | A * | 9/1999 | Strong | 114/267 |
| 6,205,945 | B1 * | 3/2001 | Passen et al. | 114/267 |
| 6,374,763 | B1 * | 4/2002 | Hartman | 114/263 |
| 7,225,751 | B2 * | 6/2007 | Rueckert | 114/259 |
| 7,426,898 | B1 * | 9/2008 | Ahern | 114/263 |
| 7,784,419 | B2 * | 8/2010 | Bigler et al. | 114/263 |
| 7,883,294 | B1 * | 2/2011 | Licina | 405/218 |
| 8,292,547 | B2 * | 10/2012 | Johanneck et al. | 405/219 |
| 2013/0206048 | A1 * | 8/2013 | Johanneck et al. | 114/263 |
| 2014/0182504 | A1 * | 7/2014 | Falcone | 114/263 |

FOREIGN PATENT DOCUMENTS

WO WO 2010151146 A1 * 12/2010

* cited by examiner

*Primary Examiner* — Lars A Olson
*Assistant Examiner* — Jovon Hayes
(74) *Attorney, Agent, or Firm* — Gordon D. Kinder

(57) ABSTRACT

A dock assembly is made of floats and deck supports on top of the floats. The floats have upwardly opening channels in which utility conduits may be laid from above before the channels are closed by the deck supports. Whalers attached to the sides of the floats and deck supports connect adjacent floats to each other. Decking may be attached to the deck supports. Rods extending from side to side hold the whalers in place and fasten the deck supports to the floats.

12 Claims, 5 Drawing Sheets

FLOATING DOCK COMPONENTS AND ASSEMBLY

TECHNICAL FIELD

The present disclosure relates floating docks and piers.

BACKGROUND

Floating docks provide advantages to marinas. Floating docks rise and fall with the tides and in normal do not use contact the ocean or lake bed, thus reducing environmental impact.

Floats that can be assembled to form a floating dock are well known, and making such floats from plastic materials has considerable advantage, including resistance to corrosion and reduced weight compared to hollow steel or concrete floats. In addition it is known to provide floats for docks constructed in a manner that allows utility conduits, e.g., for freshwater, electricity, and data to be mounted on top of floats and below the deck of a floating dock.

SUMMARY

The present application discloses a docking system comprising a plurality of floats and a plurality of deck supports topping the floats. The system includes a float having a top surface and an upwardly opening utility channel in the top surface for receiving utility conduits, and a deck support having a top surface and a bottom surface. The deck support is positionable on the float to at least partially cover the utility channel. The float has one or more tabs extending upward, and the deck support has one or more corresponding tab-receiving pockets in its bottom surface to receive the tab and to locate the deck support on the float. The tab(s) and pocket (s) each have a fastener opening to receive a fastener to secure the deck support to the float, and the deck support has a passage between the top surface and bottom surface, aligned with the utility channel and a removable panel closing the top of the passage.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

Figure 1:
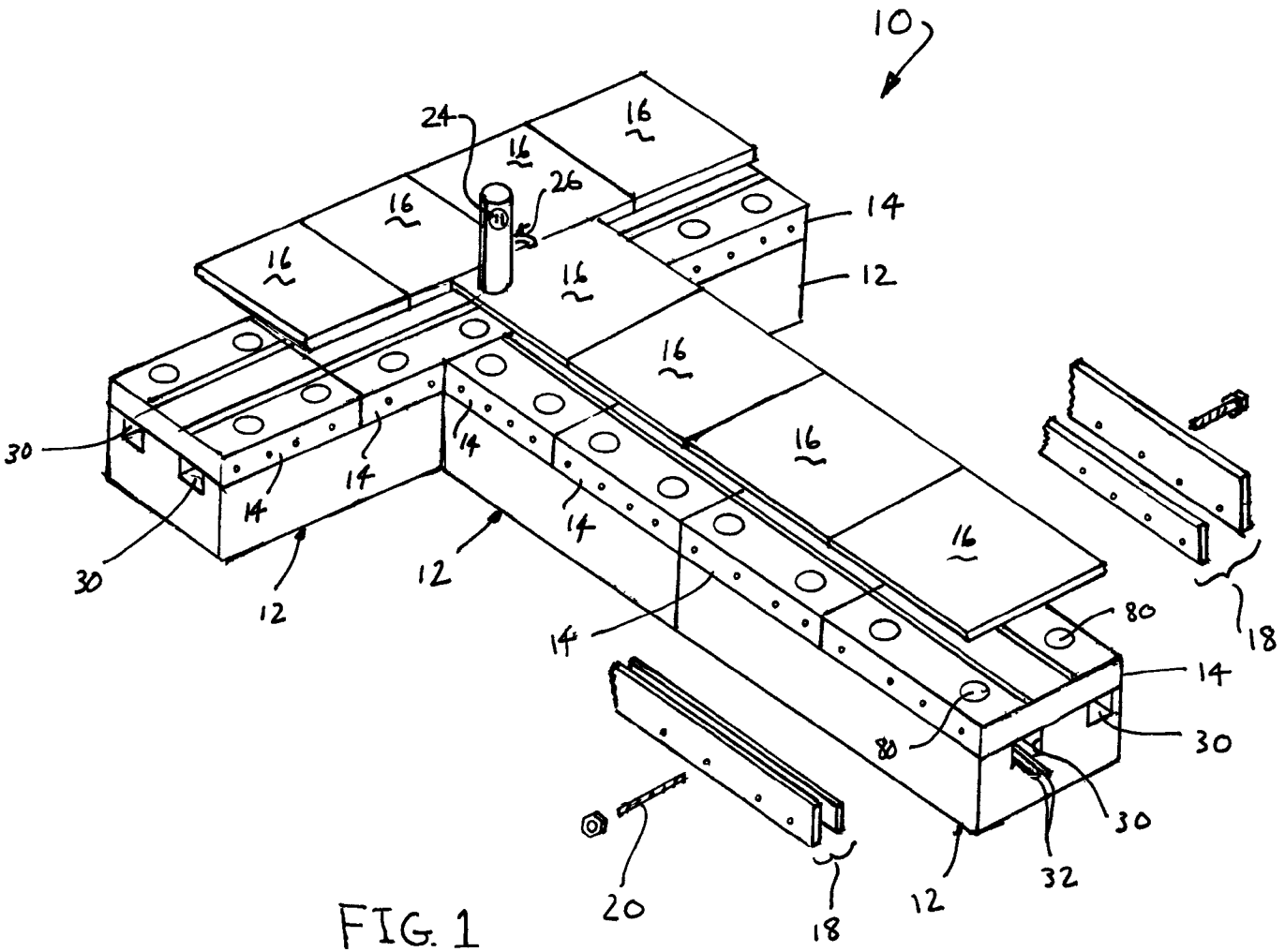
FIG. 1 is an exploded, top, perspective view of a dock as described in this application assembled from floats, deck supports, decking, and whalers.

The dock 10 illustrated in FIG. 1 is representative of docks which may be constructed following the teachings of this disclosure. The dock 10 is formed from four floats 12, eight deck supports 14 (one not shown), and eight sheets of decking

16. Whalers 18 are secured along the outside edges of the dock 10. The whalers 18 connect adjacent floats 12 to each other and are held in place by rods 20 (only one shown) located on approximate one foot centers. The rods 20 run through the deck supports 14 and floats 12.

A power pedestal 22 with electric outlets 24 and hose bibs 26 may be provided. Additional power pedestals (not shown) may be provided as required. Upwardly opening channels 32 running lengthwise in the tops of the floats carried utility conduits 32 to supply utilities such as water, electricity, and data cables. Knee braces (not shown) like those shown in U.S. Pat. No. 5,732,649 (which is incorporated herein by reference in its entirety) or other suitable braces may be used to connect portions of the dock to each other.

Although the dock 10 is shown as being the width of a single float, it is contemplated that the dock could be made twice or three times as wide by adding additional floats beside the floats 12 shown in FIG. 1. The rods 20 would then be made two or three times as long as required by the width of the dock.

Figure 3:
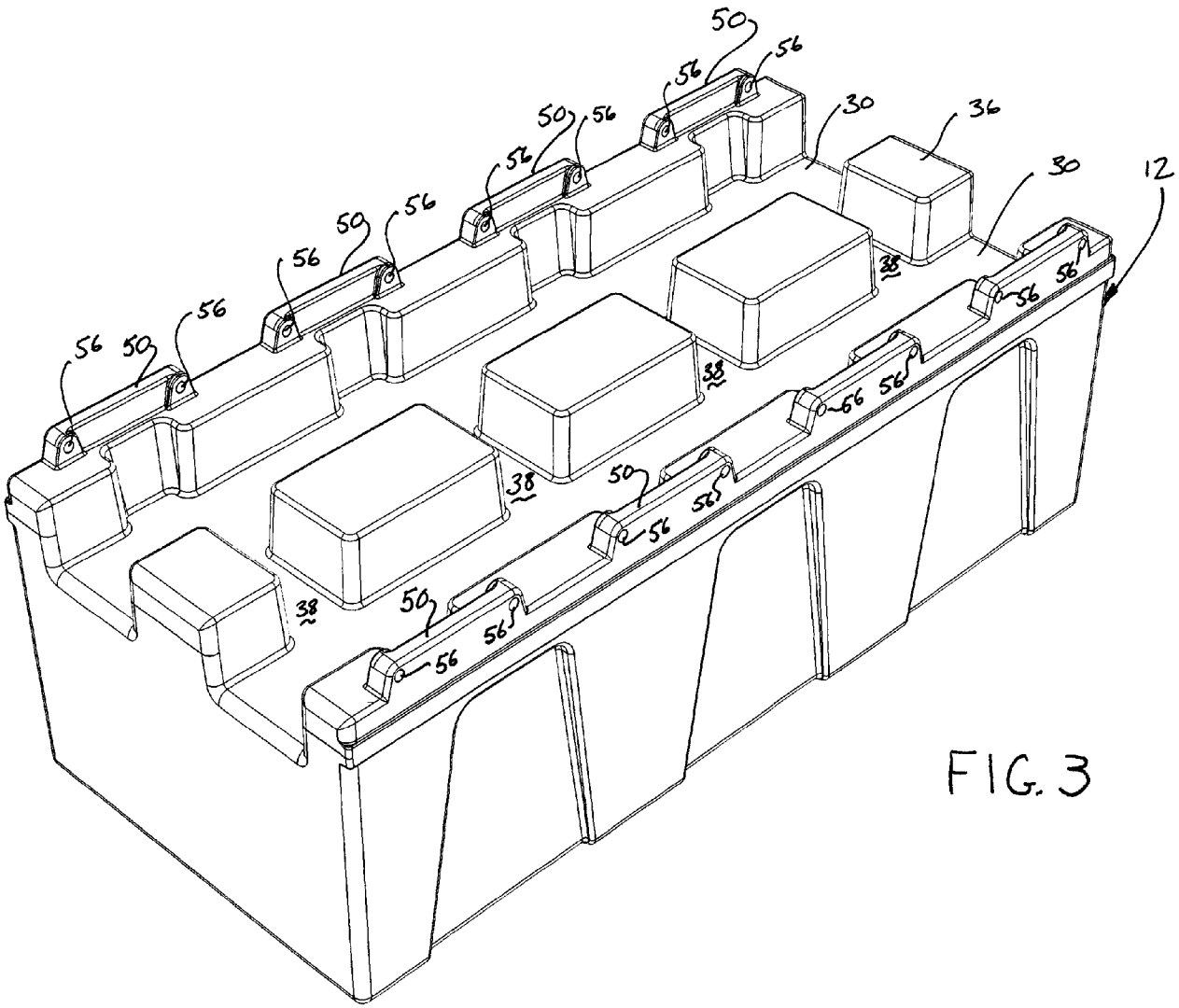
FIG. 3 is a top perspective illustration of the float of FIG. 2 showing two longitudinal utility channels and eight tabs projecting upward.

FIG. 3 shows a float 12 according to the teachings of this disclosure. The float 12 is a generally rectangular solid and may be, for example, about 4'×8'. The long sidewalls can be contoured with recesses to give them stiffness. The float 12 is made by a rotary molding process and is formed from a thermoplastic such as polyethylene. Other plastics suitable for use in a marine environment may be used, and may include so-called post-consumer materials or re-grind resin. The float 12 has a hard plastic skin roughly ¼ inch thick and is filled with closed cell foam so that even if the skin is punctured, the float does not lose its buoyancy.

The top surface 36 of the float 12 is configured to cooperate with the deck supports 14 and to form upwardly opening utility channels 30. The top surface 36 is generally flat, and the two upwardly opening channels 30 extend lengthwise. The upwardly opening channels 30 are interconnected by four transverse channels 38. The upwardly opening channels 30 and the transverse channels 38 are proportioned to receive various utility conduits 32 such as electrical conduits or flexible cables, data cables, water pipes, and the like. The interconnecting channels 30 and 38 allow flexibility in placement of the utility conduits 22 (FIG. 1) and the power pedestal 22.

Tabs 50 (FIG. 3) project upward from the top surface 36 of the float 12. The tabs 50 cooperate with pockets 52 (FIGS. 1 and 5) in the bottom 54 of the deck support 14. Each tab 50 (FIG. 3) is formed with holes 56 to receive rod 20 (FIG. 1).

In the illustrated float 12 (FIG. 3), there are eight tabs 50 (FIG. 3), four along each edge of the float. The tabs 50 each have two rod receiving passages 56 which are aligned so that a single rod 20 can pass through passages 56 in opposite tabs 50. Also as illustrated, passages 56 may be uniformly spaced, for example, at 1 foot intervals. Optionally, the tabs 50 may be smaller (that is shorter) or longer, and have more or fewer passages 56.

Figure 4:
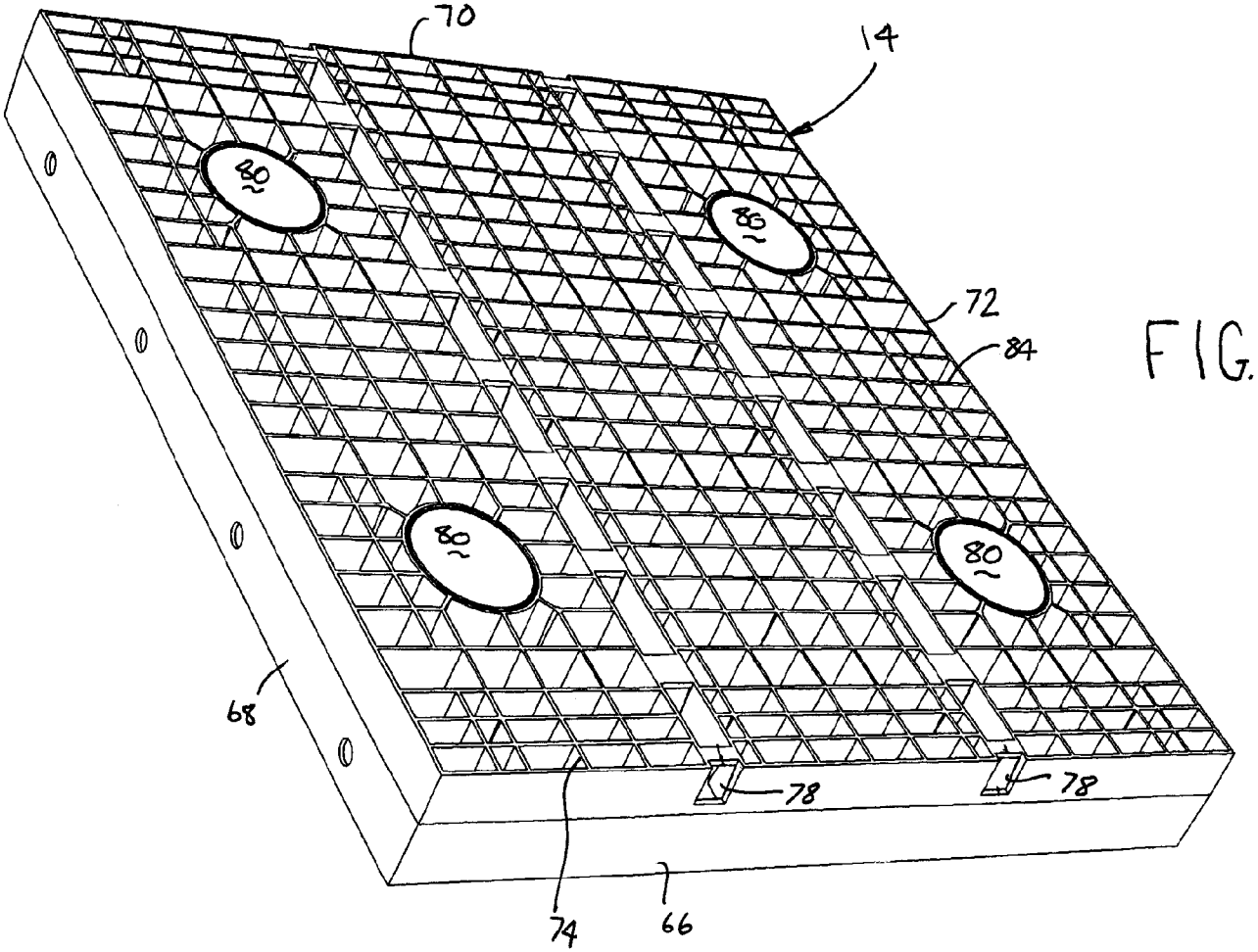
FIG. 4 is a top perspective view of the deck support of FIG. 1.

FIG. 4 shows a deck support 14 in a top perspective view. The deck support 14 is formed by a structural foam injection molding process. The deck support 14 is generally square and as illustrated is about 4 feet on a side.

The deck support 14 has four outside walls 66, 68, 70, and 72 interconnected by reticulated webs 74 (only one web 74 is numbered in the drawing) forming a rigid, lightweight structure. Two chases 78 are formed just below the top of the deck support 14 and extend from opposite outside walls 66 and 70. The chases receive nailers which may be strips of plastic or wood that are in turn used to receive fasteners which hold the decking 16 (FIG. 1) in place. The nailers may be conveniently spaced so that they divide the deck support in thirds, about 16 inches from each edge and 16 inches apart. Those skilled in the art will recognize that the nailers may be made of any material that will receive and hold fasteners used to hold the decking 16 in place. In addition to wood and plastic, the nailers could even be suitable aluminum extrusions or made of other materials.

Figure 2:
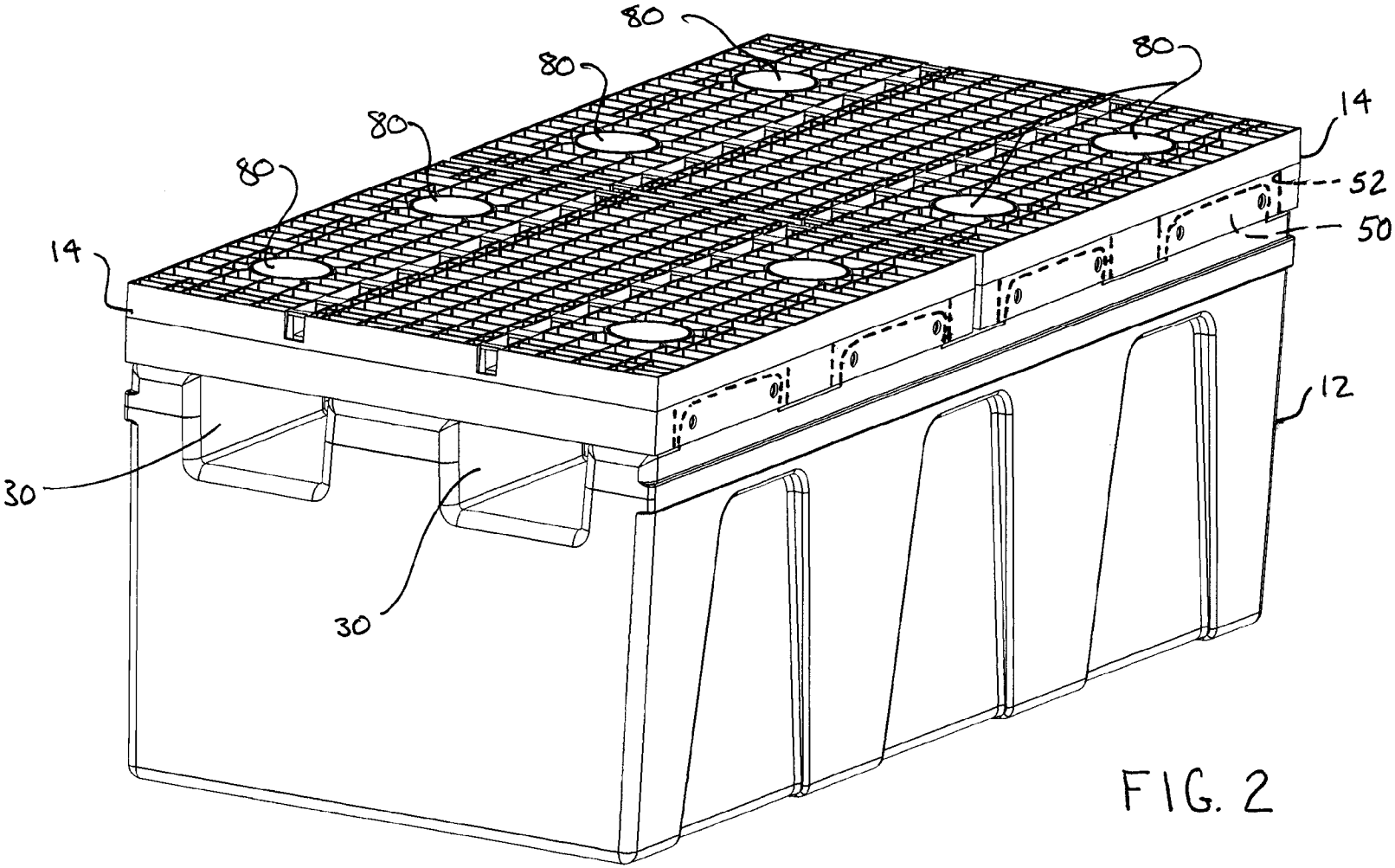
FIG. 2 shows a pair of deck supports and a float of FIG. 1 with the deck supports positioned on the float.
Figure 5:
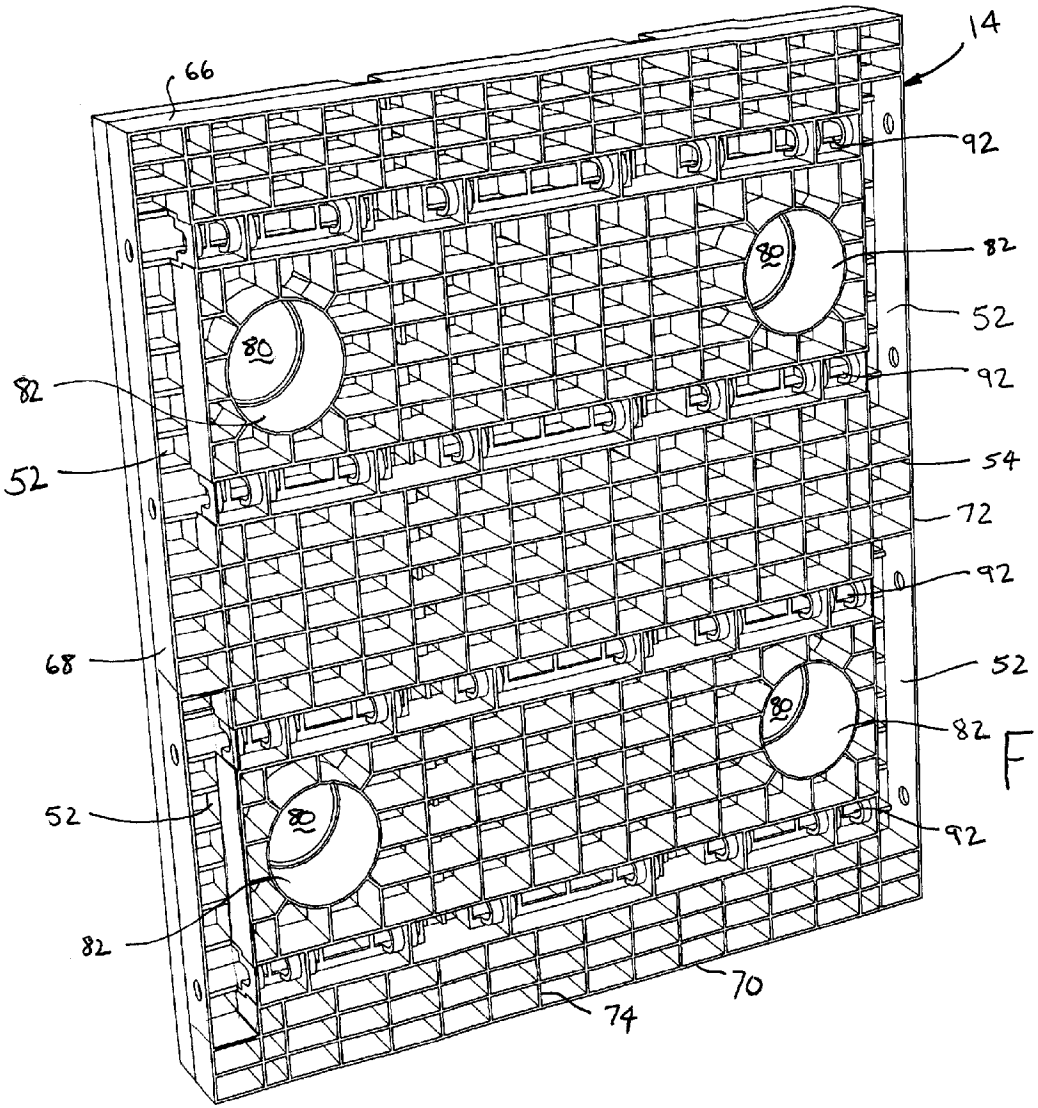
FIG. 5 is a bottom, perspective view of the deck support of FIG. 4.

Deck supports 14 also include circular knockouts 80. The knockouts 80 close the tops of cylinders 82 that extend through from the top 84 of the deck support 14 to its bottom 54 (FIG. 5). The knockouts 80 and the cylinders 82 they close are located above the upwardly opening channels 30 as shown in FIG. 2. The power pedestal 22 (FIG. 1) may be mounted to the decking 16 over one of the cylinders 82, and utility conduits 32 run through the deck support 14 after the knockout 80 is removed.

FIG. 5 shows the deck support 14 looking up from below. The deck support 14 includes chases 92 from sidewall 68 to sidewall 72 for the rods 20. The chases support and guide the rods as they are being installed, as described below. In addition the deck support 14 includes four pockets 52, two just inside the outside wall 68 and two just inside the outside wall 72. Each pocket 52 is positioned and proportioned to receive the tab 50 (FIG. 3) projecting up from the top surface 36 of the float 12. When the deck support 14 is positioned on top of a float 12, four tabs 50 that inside the four pockets 52, and the chase 92 for a tie Rod 20 aligns with each passage 56 through a tab 50.

The dock 10 (FIG. 1) is assembled by arranging the floats 12 in the desired configuration. This may be done on dry land. Utility conduits 32 may be laid in the upwardly opening channels 30 by simply laying the conduit in place, putting junction boxes (not shown) at any desired location, generally at the intersection of one of the cross channels 38 with a utility channel 30. Connections between conduits and between conduits and junction boxes can be made easily from above because the conduits and boxes are lying in an upwardly opening channel 30. The conduits 32 may be stubbed out so that the power pedestal 22 may be easily installed later.

After conduits 32 are laid and stubbed as required, the deck supports 14 are prepared. Specifically, knockouts 80 a removed wherever stubbed conduits rise. The deck supports 14 then can then be placed on top of the floats 12. The tabs 50 in the floats are received in the corresponding pockets 52. When so assembled, the bottom surface 54 of the deck support 14 (defined by the bottom edges of the webs 74) rest on the top surface 36 of the float 12, distributing the load from the deck broadly across the top of the float. The deck supports 14 thus close the open tops of the upwardly opening utility channels 30. At the same time the passages 36 through the tabs 50 are aligned with the chases 92 through the deck supports 14.

With the deck supports 14 in place, the whalers 18 can be attached and secured with the rods 20. The whalers 18 may be a single plank extending the length of the deck 10, or multiple planks in a single layer. Alternatively, the whalers 18 may be double planks as shown in FIG. 1. In either case breaks between the planks are located so as not to align with the ends of the floats 12. In this manner the whalers 18 connect the floats 12 to each other. Although the whalers 18 are described as planks such as 2"×10" pressure treated lumber, other materials may be used such as untreated lumber, engineered plastics and or metals such as aluminum and steel, depending on the environment in which the dock will be used as well as other engineering considerations.

After the whalers 18 are bolted in place, decking 16 may be installed. The whalers 18 provide a point of fastening the decking 16 at the edges of the deck supports 14 and nailers may be installed in chases 78 to fasten the decking 16. The power pedestal(s) 22 may be mounted to the decking 16 over any of the knockouts 80 as desired for a particular dock arrangement.

While the inventive principles have been illustrated by the description of various embodiments thereof, and while the embodiments of been described in considerable detail, it is not intended to restrict or in any way limit the scope of the appended claims to such detail. Additional advantages and modifications will be readily apparent to those skilled in the art. The invention in its broader aspects is therefore not limited to the specific details, representative apparatus, methods and examples shown and described. Accordingly, departures may be made from such details without departing from the scope or spirit of the general inventive principles.

The invention claimed is:

1. A docking system comprising a plurality of floats and a plurality of deck supports topping the floats, including a float having a top surface and an upwardly opening utility channel in the top surface for receiving utility conduits, a deck support having a top surface and a bottom surface, and the deck support being positionable on the float to at least partially cover the utility channel, the float having a tab extending upward and the deck support having a corresponding tab-receiving pocket in said bottom surface to receive the tab and to locate the deck support on the float, the tab and pocket each having a fastener opening to receive a fastener to secure the deck support to the float, and the deck support having a passage between the top surface and bottom surface, aligned with the utility channel and having a removable panel closing the top of the passage.

2. The system of claim 1 wherein the fastener opening in the tab and the fastener opening in the pocket align along a generally horizontal axis when the tab is in the pocket.

3. The system of claim 2 wherein the float has a top surface and at least two opposing sides, the tab extends upward from one side, and further including a second tab extending upward from the opposite side, and wherein the deck support has a pair of tab receiving pockets one corresponding to each of the tabs, and each of the tabs and each of the pockets having a fastener opening, the fastener openings defining a common generally horizontal axis when the deck support is positioned on the float and the tabs are received in the deck support pockets.

4. The system of claim 3 further including a single fastener extending through the openings in the tabs and the pockets.

5. The system of claim 3 wherein the fastener is a thin, straight bar.

6. The system of claim 5 further including a whaler along at least one of the opposing sides of the float and secured in place by the thin, straight bar.

7. The system of claim 5 wherein the upwardly opening utility channel defines an axis generally parallel to the one side and transverse to the axis of the thin, straight bar.

8. The system of claim 7 wherein the floatation unit includes a second upwardly opening utility channel parallel to the first upwardly opening utility channel, and a second passage between the top surface and the bottom surface aligned with the second utility channel and having a removable panel closing the top of the second passage.

9. The system of claim 8 wherein the passage and the second passage between the top and bottom surfaces of the deck support are generally cylindrical, and the panels are removable to provide access to the upwardly opening utility channel.

10. The system of claim 1 wherein the floatation unit includes a plastic shell filled with closed cell foam.

11. The system of claim 10 wherein the deck support is formed of a thermoplastic material and includes a honeycomb structure for rigidity.

12. The system of claim 1 wherein the flotation unit has generally parallel opposing sides and includes four tabs projecting upward, two along each of the opposing sides, and the deck support includes four tab-receiving pockets formed in the bottom surface to receive the tabs projecting upward from the float, and the tabs and pockets include passages which align when the tabs are in the pockets to permit a fastener to extend through the passages to secure the deck support to the float.

* * * * *